US005964202A

United States Patent [19]

Takagi et al.

[11] Patent Number: 5,964,202

[45] Date of Patent: Oct. 12, 1999

[54] CONTROLLING APPARATUS FOR THROTTLE VALVE AND FOR DRIVING IN INTERNAL COMBUSTION ENGINE

[75] Inventors: Noboru Takagi; Katsuhiko Kodama, both of Toyota, Japan

[73] Assignee: Toyota Jidosha Kabushiki Kaisha, Toyota, Japan

[21] Appl. No.: 09/033,501

[22] Filed: Mar. 2, 1998

[30] Foreign Application Priority Data

Mar. 3, 1997 [JP] Japan ..... 9-048266

[51] Int. Cl.[6] ..... F02D 9/10; F02D 11/10

[52] U.S. Cl. ..... 123/339.1; 123/361

[58] Field of Search ..... 123/399, 339.1, 123/339.16, 339.17, 339.14, 339.19, 339.2, 339.23, 325, 320, 361

[56] References Cited

U.S. PATENT DOCUMENTS 4,462,355 7/1984 Ozaki et al. ..... 123/325
4,481,923 11/1984 Ozaki ..... 123/320
5,546,903 8/1996 Satou et al. ..... 123/399
5,630,394 5/1997 Grizzle et al. ..... 123/339.23

FOREIGN PATENT DOCUMENTS 763083A 3/1995 Japan .

*Primary Examiner*—Willis R. Wolfe
*Assistant Examiner*—Mahmoud M. Gimie
*Attorney, Agent, or Firm*—Kenyon and Kenyon

[57] ABSTRACT

It is an object of the present invention to provide a controlling apparatus for throttle valve that detects a throttle open degree enabling more appropriate controls by removing ill effects of multiplexing an idle control in controlling data. The idle control amount is canceled by subtracting the idle target open degree from the detected throttle open degree. Further, in order to correct differences of the detected data due to a response delay of the throttle valve, the previous measured value is regarded as the detected throttle open degree when the response delay occurs.

4 Claims, 9 Drawing Sheets

FIG. 3

| ENGINE COOLANT TEMPERATURE (°C) | THROTTLE OPEN DEGREE (deg) |
|---|---|
| · | · |
| 0 | a |
| ·<br>·<br>· | ·<br>·<br>· |
| ν | ρ |
| ·<br>·<br>· | ·<br>·<br>· |
| 80 | σ |
| · | · |

FIG. 4

| ISSUANCE LOAD SIGNAL | AIR AMOUNT FOR ISSUANCE LOAD COMPENSATION |
|---|---|
| AIR CONDITIONER | A |
| POWER STEERING | B |
| LIGHT | r |
| ⋮ | ⋮ |

FIG. 5

AIR AMOUNT FOR COMPENSATION (L/MIN)

THROTTLE OPEN DEGREE (DEG)

| | 0 · · · | A | · · · 1000 · · · |
|---|---|---|---|
| 0 ⋮ | | | |
| δ | | ζ | |
| ⋮ 90 | | | |

CONTROLLING APPARATUS FOR THROTTLE VALVE AND FOR DRIVING IN INTERNAL COMBUSTION ENGINE

BACKGROUND OF THE INVENTION

1. Field of the Invention

The present invention relates to a controlling apparatus for throttle valve in internal combustion engines, in which both an idle speed control (ISC) and an output control in response to a usual accelerator operation are controlled by a throttle valve and, moreover, relates to a controlling apparatus for driving in internal combustion engines which controls based on an open degree of a throttle valve.

2. Description of the Related Art

It is well-known that in an internal combustion engine, an intake air amount of an engine is adjusted by a throttle valve and an engine output is controlled by a throttle open degree. In controlling, a throttle valve controlling apparatus of electronically control type is known, in which both the idle speed control (ISC) and the output control in response to the usual accelerator operation is made by a single throttle valve.

In this kind of device, Japanese Patent Laid-Open Publication No.7-63083 disclosed that an idle speed control means (ISC means) for controlling a single throttle valve is provided so that an actual revolution speed of the internal combustion engine when idling becomes a target revolution speed of idling as stored beforehand based on a calculation of a throttle open degree. Further, when idling, the throttle valve is controlled by the ISC means so that the throttle open degree becomes the target revolution speed of the idling as stored beforehand.

A throttle sensor for detecting a throttle open degree is provided with the throttle valve so as to detect the throttle open degree. But a throttle open degree signal in use for engine control, etc. uses a value that a throttle fully-closed learning value is subtracted from the actual throttle open degree signal as apparent from an expression below:

Throttle open degree signal($TA$)= actual detected value of throttle sensor throttle− fully-closed learning value

The throttle valve has a mechanical construction but due to assembly errors to the internal combustion engine, only detecting a throttle open degree by the throttle sensor becomes the open degree that includes the errors. Therefore, every time when starting the internal combustion engine, first, the throttle valve is fully closed and the fully-closed position is learned. Then, the throttle fully closed learning value is subtracted from the actual value which is detected by the throttle sensor so as to obtain an accurate throttle open degree.

However, in the internal combustion engine, load such as an air-conditioner, etc. is connected. In response to the size of the load, the target revolution speed of the internal combustion engine when idling is changed.

For example, the air conditioner has a compressor for refrigerant circulation, which is connected to a driving shaft of the internal combustion engine via a magnet clutch so as to drive the compressor. When the air conditioner is turned on at the time of idling, the magnet clutch is connected. But to avoid the engine to stall due to the load and to drive the compressor, the ISC means increases the target revolution speed in response to the load.

The apparatus mentioned above, in addition to the control by the ISC means, the usual control of the throttle valve by an accelerator pedal operation is conducted. Thus, when the accelerator pedal is pressed, the throttle valve is opened in response to the amount the pedal was pressed.

As apparent from the above, the actual detecting value of the throttle sensor includes a required throttle open degree balancing with the target revolution speed at the idling state. Even when the accelerator pedal is held constant, the required open degree by the ISC is changed in response to the condition of a load such as the air conditioner, etc. Thus, the throttle open degree signal is changed.

This brings great influences to various engine controls which use the throttle open degree as a controlling parameter.

For instance, when the air conditioner is turned on at the idling state, the target revolution speed increases and he target throttle open degree becomes large in response to the load of the air conditioner by the ISC means. Later, when the air conditioner is turned off, the target revolution speed when idling and the target throttle open degree are set low. However, since the actual throttle valve is open and closed by the mechanical operation, even when the target throttle open degree is set low, the throttle valve is not closed immediately because of response delay but is closed gradually.

Accordingly, when the throttle open degree is detected during the response delay, the throttle open degree is calculated which includes the delay. In other words, the throttle open degree signal subtracted the throttle full-closed learning value from the actual detecting value by the throttle sensor which detects the open degree of the throttle valve not reached to the target open degree due to delay becomes larger than the throttle open degree based on the target throttle open degree as originally required. The engine control based on the throttle open degree becomes not balancing with the originally required controlling.

Moreover, since the control by the ISC means and the throttle open degree control based on the accelerator pedal coexist, when considering from an electronic controlling by computers, the change of the throttle open degree is uncertain whether it is due to by the ISC means or by the accelerator pedal. As a result, there are some cases that engine controls in response to the accelerator pedal by the actual driver are not made. Thus, the drivability becomes bad.

SUMMARY OF THE INVENTION

It is therefore an object of the present invention to provide a controlling apparatus for throttle valve which removes ill effect that an idle controlling amount is multiplexed in controlling data and detects a throttle open degree enabling more appropriate controlling. To achieve the foregoing object of the present invention, the following means are adopted.

According to the present invention, the controlling apparatus for throttle valve in an internal combustion engine comprising;

idle speed control means for setting a throttle open degree required when idling as an idle target open degree, accelerator target open degree setting means for setting an accelerator target open degree in response to an accelerator operation, and throttle target open degree setting means for setting a throttle target open degree which includes both the idle target open degree set in the idle speed control means and the accelerator target open degree set by the accelerator target open degree setting means;

wherein feedback controlling is conducted for the throttle target open degree set by the target open degree setting means; further comprising;

throttle open degree detecting means for detecting a throttle open degree, and compensating means for compensating the throttle open degree detected by the throttle open degree detecting means in view of the idle target open degree.

Here, the compensating means can be constructed so as to compensate the throttle open degree by subtracting the idle target open degree from the throttle open degree detected by the throttle open degree detecting means.

Thus, a true throttle valve open degree which corresponds to an accelerator operation is obtained by subtracting the idle target open degree.

Further, the controlling apparatus can be further comprised in addition to the above construction;

acceleration/reduction judging means for judging whether the vehicle is under the acceleration condition or the reduction condition;

comparing means for comparing the throttle open degree after compensated by the compensating means with the previously measured throttle open degree after compensated; and throttle open degree holding means for holding a previous throttle open degree as originally required throttle open degree when the acceleration/reduction means judged as the acceleration state and the comparing means decided that the present throttle valve open degree is smaller than the previous throttle open degree, in addition to when the acceleration/reduction judging means judged as the reduction state and the comparing means decided that the present throttle open degree is larger than the previous throttle open degree.

The throttle valve produces a different throttle open degree from the original throttle open degree which is due to mechanical operational delay. In this case, the influence of delay can be avoided by maintaining the previous throttle open degree as mentioned above.

The present invention is preferably used to a controlling apparatus for driving in internal combustion engines such as a controlling apparatus for fuel injection amount, a controlling apparatus for fuel ignition, etc. which utilizes the throttle open degree as a controlling parameter.

As for such controlling apparatus, a controlling apparatus for driving in internal combustion engines; a throttle open degree required at the idling is set as an idle target open degree as well as setting an accelerator target open degree in response to the accelerator operation, a throttle target open degree is set including both the idle target open degree and the accelerator target open degree, and a throttle valve is feedback controlled for the throttle target open degree, wherein a driving controlling is conducted based on changes of the throttle open degree; and comprises;

throttle open degree detecting means for detecting a throttle open degree; and compensating means for compensating the throttle open degree detected by the throttle open degree detecting means in view of the idle target open degree, wherein the driving of the internal combustion engine is controlled based on the throttle open degree compensated by the compensating means.

BRIEF DESCRIPTION OF THE DRAWINGS

FIG. 3 is a map showing a relation between an engine coolant water temperature and a throttle open degree;

FIG. 4 is a map showing a relation between a load and an air amount for compensating the load;

FIG. 5 is a map showing a relation between an air amount for compensation and the throttle open degree;

DESCRIPTION OF THE PREFERRED EMBODIMENT

Preferred embodiments of the present invention will now be described with reference to the accompanying drawings.

<Embodiment 1>

The first embodiment will now be explained.

(Explanation of Apparatus Construction)

Figure 1:
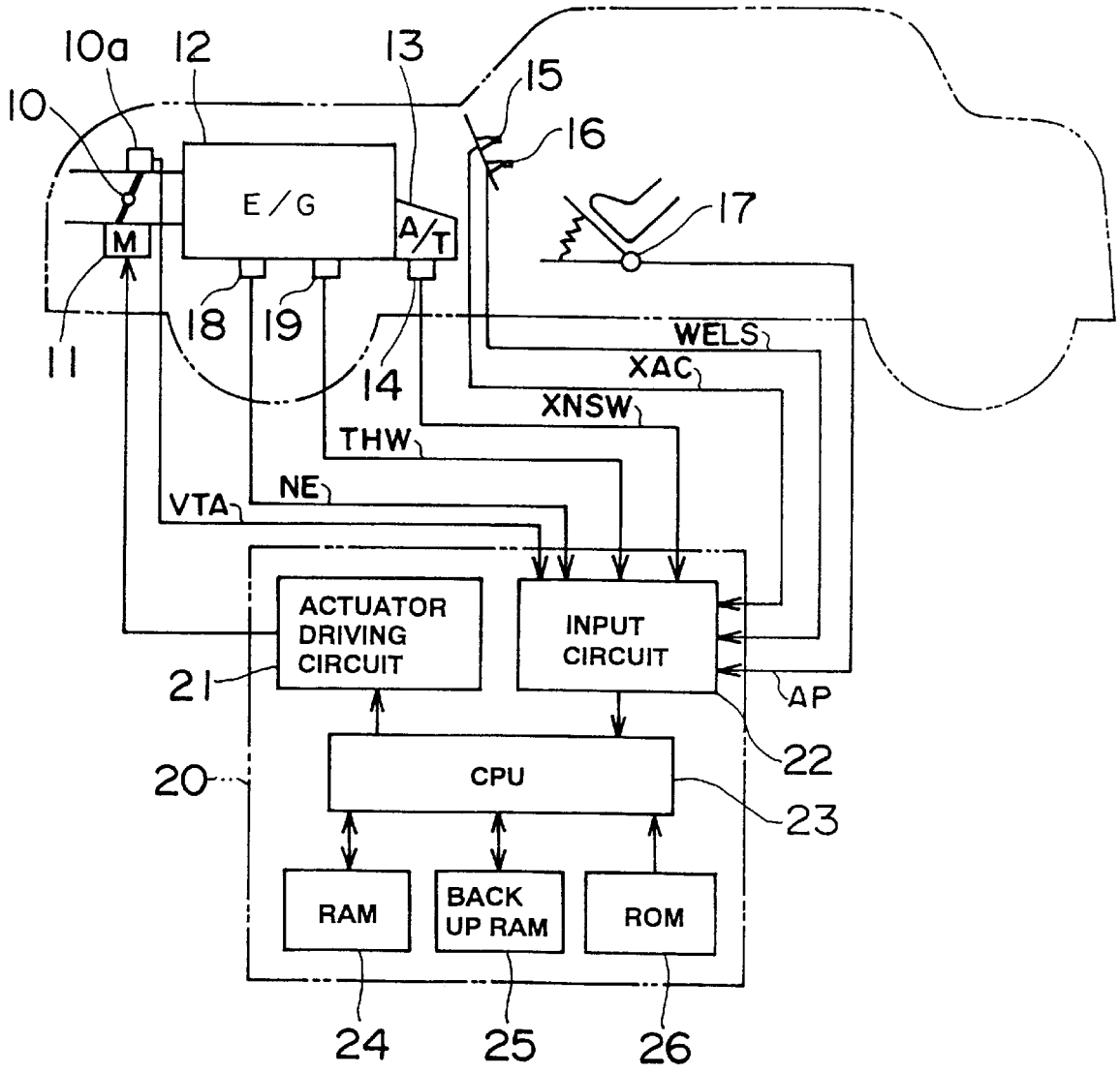
FIG. 1 is a diagram showing one example of the whole construction of a controlling apparatus for throttle valve according to the present invention.

FIG. 1 shows a controlling apparatus for throttle valve. As shown in FIG. 1, a throttle valve 10 is provided in an intake pipe which is connected to cylinders of internal combustion engine 12 as well as an actuator 11 consisting of a stepping motor, etc. to open and close the throttle valve 10 is provided. An automatic transmission 13 is connected to the internal combustion engine 12 where a neutral switch 14 outputting neutral signals corresponding to the neutral position of the automatic transmission 13 is provided.

Further, a switch for air conditioner 15 outputting signals of an air conditioner in response to ON/OFF of the air conditioner driven by the internal combustion engine is provided. Furthermore, an electric load switch 16 outputting electric load signals in response to ON/OFF of head lamps and fog lamp, etc. is provided. Furthermore, an accelerator position sensor 17 detecting a pressing amount of an accelerator pedal and accelerator position signals is provided. An engine revolution speed sensor 18 detecting and outputting an engine revolution speed in the internal combustion engine is provided. Further, a water temperature sensor 19 detecting a cooling water temperature of a radiator for cooling the internal combustion engine and outputting the water temperature is provided. A throttle position sensor 10*a* detecting a throttle open degree 10 is provided.

Signals from the neutral switch 14, the air conditioner switch 15, the electric load switch 16, the accelerator position sensor 17, the engine revolution speed sensor 18, the water temperature sensor 19 and the throttle position sensor 10*a* are inputted to a central processing unit (CPU) 23 of an electronic control unit (ECU) 20 via an input circuit 22 and are utilized as controlling data. A driving circuit 21 is connected to the CPU 23 so as to drive the actuator for driving the throttle valve according to the controlling amount which is calculated by the CPU 23 based on the input data from these switches, etc.

Further, the CPU 23 are connected with a RAM 24 storing various processing data, a back-up RAM 25 for back up by batteries so as to maintain the stored data permanently and a ROM 26 storing programs, etc.

The major construction of the controlling apparatus according to the present invention is realized on the CPU 23 by the program stored in the ROM 26.

Figure 2:
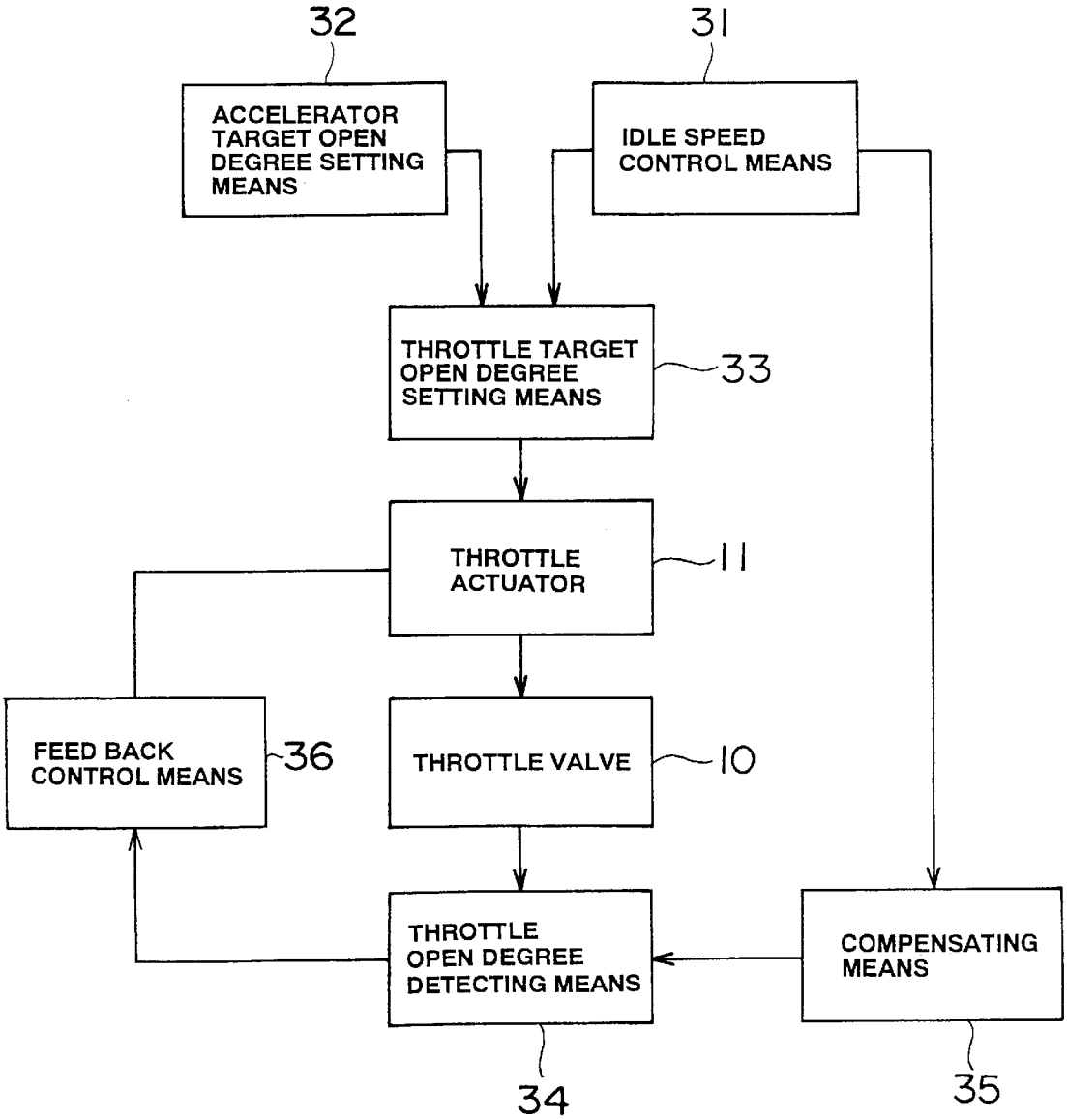
FIG. 2 is a functional block diagram of embodiment 1 according to the present invention.

In other words, as shown in FIG. 2, the following function realizing means are realized by the program.

(1) idle speed control means (ISC means) 31 for setting a throttle open degree required at the time of idling as an idle target open degree;

The throttle open degree required at the time of idling is that the throttle open degree for securing the necessary engine revolution speed for idling. When an internal combustion engine is not accompanied by load, it is sufficient for a little engine revolution speed. But when load such as an air conditioner, head lamps, fog lamps are accompanied, the engine revolution speed is increased balancing with the load so that a compressor for an air conditioner and an alternating generator are driven.

In fact, to obtain the idle target open degree, as shown in FIG. 3, a relation between an engine cooling water temperature and a throttle open degree was stored beforehand in a map in the back up RAM 25. An air amount for issuance load compensation in response to the load is stored as a map in the back up RAM so as to compensate the idle target open degree in response to the load of the air conditioner, etc., as shown in FIG. 4. Further, as shown in FIG. 5, a map decided a size of throttle open degree for an air amount for compensation is stored in the back up RAM 25 so as to compensate the idle target open degree in response to the load of the air conditioner, etc. in which the throttle open degree is led from the map for compensating the air amount in response to the load.

(2) accelerator target open degree setting means 32 setting an accelerator target open degree in response to the accelerator operation;

The throttle valve does not have a mechanical connection with the accelerator pedal but is controlled electrically for an accelerator target open degree according to the accelerator operation amount which is detected by an accelerator position sensor 17, that is, a pressing amount of the accelerator pedal. A map showing a relation between an accelerator operation amount and an accelerator open degree is stored in the back-up RAM 25 (not shown), and the accelerator open degree in response to the accelerator operation amount is led from the map as the accelerator target open degree.

(3) throttle target open degree setting means 33 setting the throttle target open degree including both the idle target open degree set by the idle speed control means 31 and the accelerator target open degree set by the accelerator target open degree setting means 32;

The throttle target open degree setting means 33 sets a final throttle target open degree totaling the idle target open degree set by the ISC means 31 and the accelerator target open degree set by the accelerator target open degree setting means 32.

As a result, the throttle valve 10 is open and closely controlled including not only the accelerator target open degree according to the accelerator operation amount but also to include the idle target open degree.

Further, Japanese Patent Laid Open No. 7-63083 disclosed a method for calculating an idle target open degree of the present invention as "the ISC target open degree after compensated", a method for calculating an accelerator target open degree and a method for calculating a target throttle open degree by adding them, but these methods are applicable to the present invention.

(4) throttle open degree detecting means 34 calculating a throttle open degree from detecting signals from the throttle position sensor 10*a;*

The throttle position sensor 10*a* detects an open degree of the actual throttle valve 10 and inputs the detecting signals to the input circuit 22 as digital signals by an A/D convertor. This is called a throttle sensor A/D value (TAAD).

In order to detect the throttle open degree, it is not sufficient to obtain the throttle sensor A/D value (TAAD) only. The throttle valve 10 has mechanical errors which are necessary to correct them. That is, in order to detect the throttle open degree, the throttle valve 10 is fully closed beforehand and the output from the throttle position sensor 10*a* at the fully closed position is stored as the fully closed throttle position in the RAM 24. This is called a throttle fully closed learning value (GTA). The original throttle open degree is obtained by subtracting the throttle fully closed learning value (GTA) from the throttle sensor A/D value (TAAD).

This is expressed in an expression:

throttle open degree ($TA1$)= throttle sensor A/D value ($TAAD$)−throttle fully closed learning value ($GTA$) (1)

(5) compensating means 35 compensating the throttle open degree detected by the throttle open degree detecting means 34 in view of the idle target open degree;

The compensating means 35 subtracts the idle target open degree from the throttle open degree detected by the expression (1) by the throttle open degree detecting means 34.

In other words, the throttle open degree (eta) obtained by the expression (1) includes the throttle open degree in response to the idle target open degree set by the ISC means 31. Accordingly, when the throttle open degree changes, it is not certain, when looking from the detecting side of the throttle open degree, whether this change is due to pressing the accelerator pedal or to the idle target open degree by the changes of the load such as the air conditioner, etc.

Thus, when the throttle open degree obtained by the expression (1) is controlled by various controls such as fuel ignition timing and fuel injection, the control which should be done in response to pressing the accelerator pedal is conducted in the case when the accelerator pedal is not pressed but only when the air conditioner is operated. An appropriate control cannot be conducted.

Thus, in accordance with the expression (2) mentioned below, the idle target open degree is subtracted from the throttle open degree detected by the expression (1).

Throttle open degree ($TA2$)= throttle sensor A/D value ($TAAD$)−throttle fully-closed learning value ($GTA$)−idle target open degree ($TAISC$)=throttle open degree ($TA1$)−idle target open degree ($TAISC$) (2)

By this, even when the load is changed by turning on/off the air conditioner, etc., the throttle open degree (TA2) is not changed resulting no influence to the engine control, etc.

(6) Feedback controlling means 36 conducting a feedback control for the throttle target open degree set by the throttle target open degree setting means 33;

The internal combustion engine is feedback controlled so as to reach the target revolution speed in response to the throttle target open degree. In other words, when the throttle open degree detected by the expression (1) is net reached to the target value, it is controlled so as to open or close the throttle valve in the direction that reaches to the target value.

<Operation and effect of the embodiment 1>

Next, a control of the throttle valve by means of the function realizing means will be explained in reference with a flowchart of FIG. 6 and a timing chart of FIG. 7.

Figure 6:
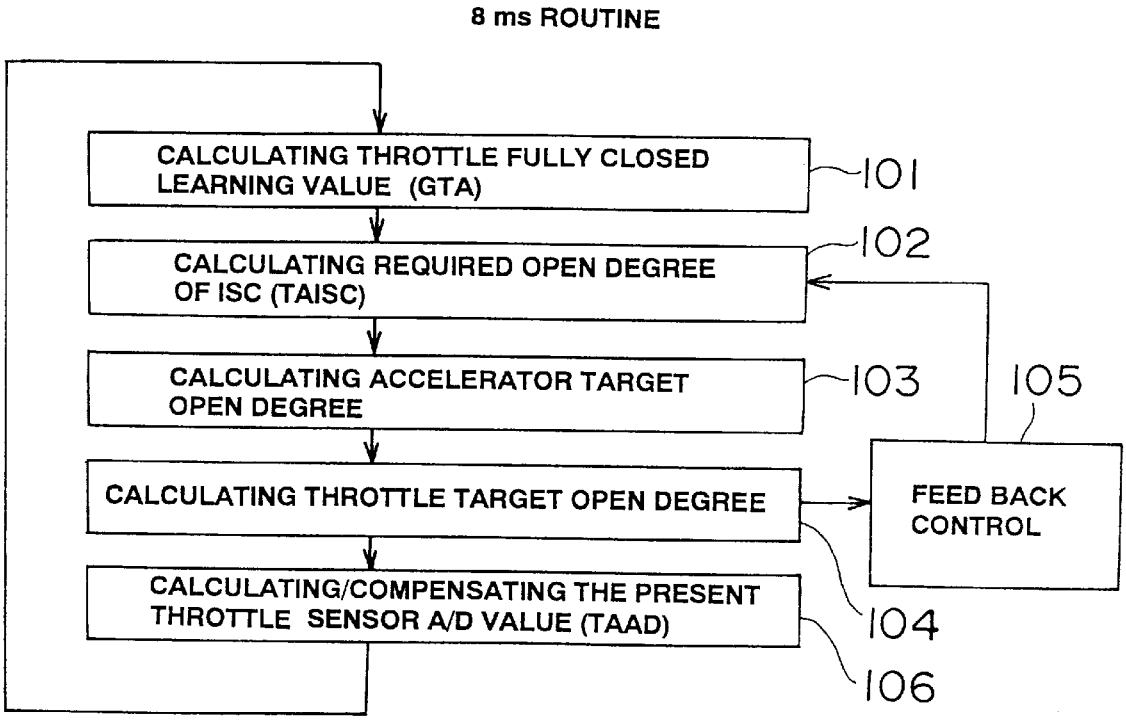
FIG. 6 is a flowchart showing actions of the embodiment 1 according to the present invention.

A calculation of the throttle open degree for various controlling is executed as a routine program at every 8 ms. according to the flowchart in FIG. 6.

First, when the engine is started, the throttle valve is fully closed and the fully closed position is stored as the throttle fully closed learning value (GTA) (step 101).

Next, according to FIGS. 3–5 from the engine cooling water temperature, etc., the idle target open degree is calculated by the ISC means 31 (step 102).

Further, an accelerator operation amount is calculated in accordance with the signals from the accelerator position sensor in response to the pressing amount of the accelerator pedal by a driver.

The accelerator target open degree is led from the map by the accelerator target open degree setting means 32. (step 103)

The obtained idle target open degree and the accelerator target open degree are added by the throttle target open degree setting means 33 so as to obtain a throttle target open degree for control target (step 104).

Normally, the throttle valve 10 is controlled by the feed back controlling means 36 so as to be consistent with the throttle target open degree (step 105).

When feed back controlling, in order to judge whether the throttle valve 10 is consistent with the throttle target open degree, it is necessary to detect the actual throttle open degree by the throttle open degree detecting means. But in case of the feedback controlling, the detection expression is based on the expression (1) mentioned above.

However, when conducting the engine fuel injection control or the fuel ignition control and when the expression (1) is used, the throttle open degree includes the open degree in response to the idle target open degree. Irrespective the accelerator operation is not performed but when there are changes in response to the load of the air conditioner, etc., it is not certain from the controlling side that the changes are due to whether the accelerator operation or the load of the air conditioner, etc. Thus, when the throttle open degree is spreading based on turning on the air conditioner is turned on, a fuel injection control as the same as when the increase of the accelerator operation amount is conducted.

Accordingly, when the output of the internal combustion engine changes, the drivability is damaged because this is unexpected change when looking from the driver.

Therefore, for the data for the fuel injection control and the fuel ignition control, the expression (1) is compensated by the compensating means 35 according to the expression (2), and to cancel influences by the ISC means 31 (step 106).

Figure 7:
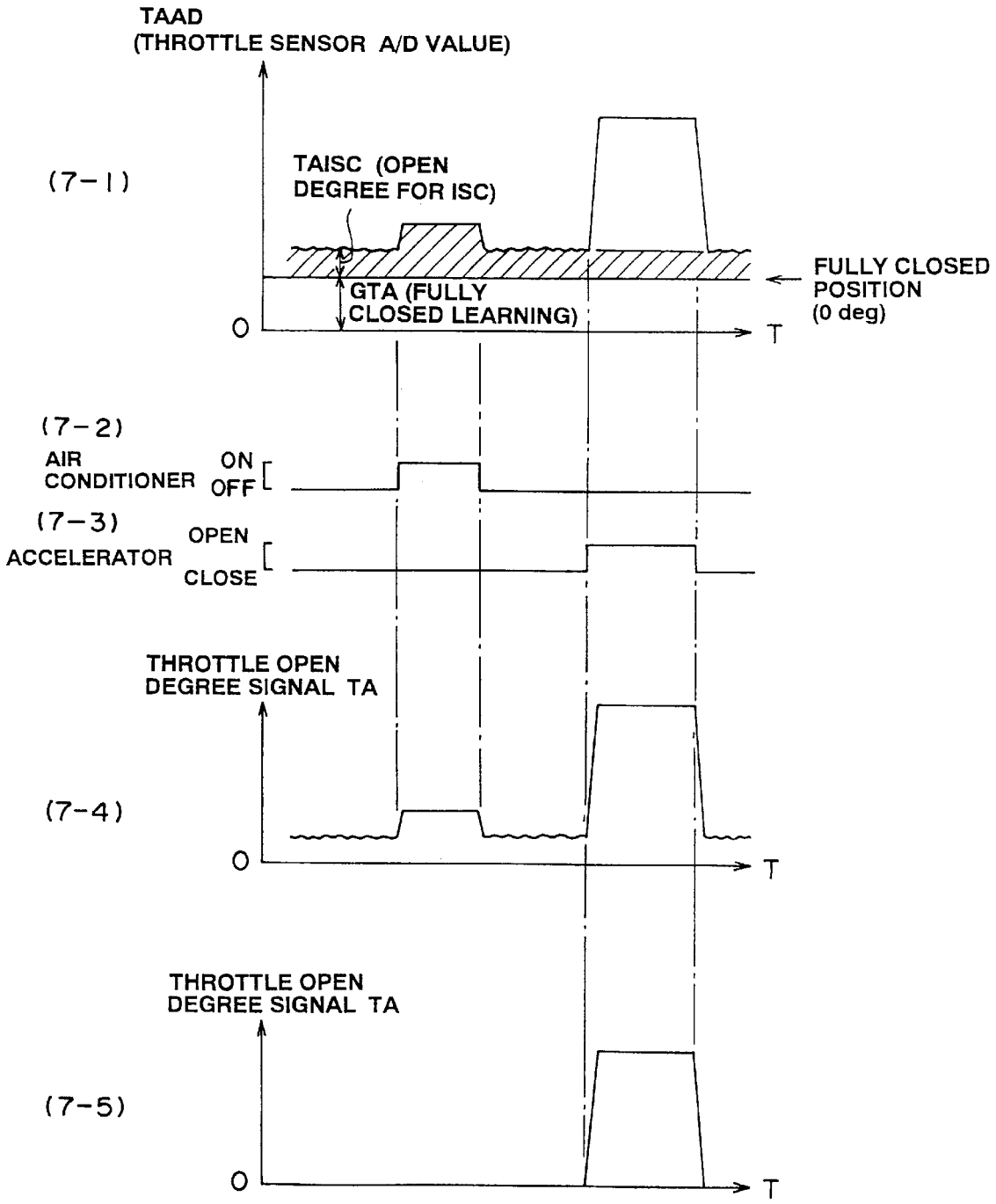
FIG. 7 is a timing chart showing actions of the embodiment 1 according to the present invention.

Looking by the timing chart of FIG. 7, the idle target open degree changes by turning ON/OFF the air conditioner. In response to the changes, the throttle open degree detected also changes. The ISC is canceled by the compensation by the compensating means 35 as shown in (7-5) when compared with the conventional examples shown in(7-4). Only the changes of the throttle open degree in response to the accelerator operation remain. In the fuel injection control and the fuel ignition control, the remaining change corresponding to the accelerator operation is used as controlling data.

As a result, the engine control not influencing on the changes to the load of the air conditioner, etc. is conducted. Consequently, the drivability can be improved.

[Embodiment 2]

Next, the second embodiment will be explained with reference to the drawings.

Since the construction of apparatus is the same as the embodiment 1 shown in FIG. 1, the explanation is omitted.

Figure 8:
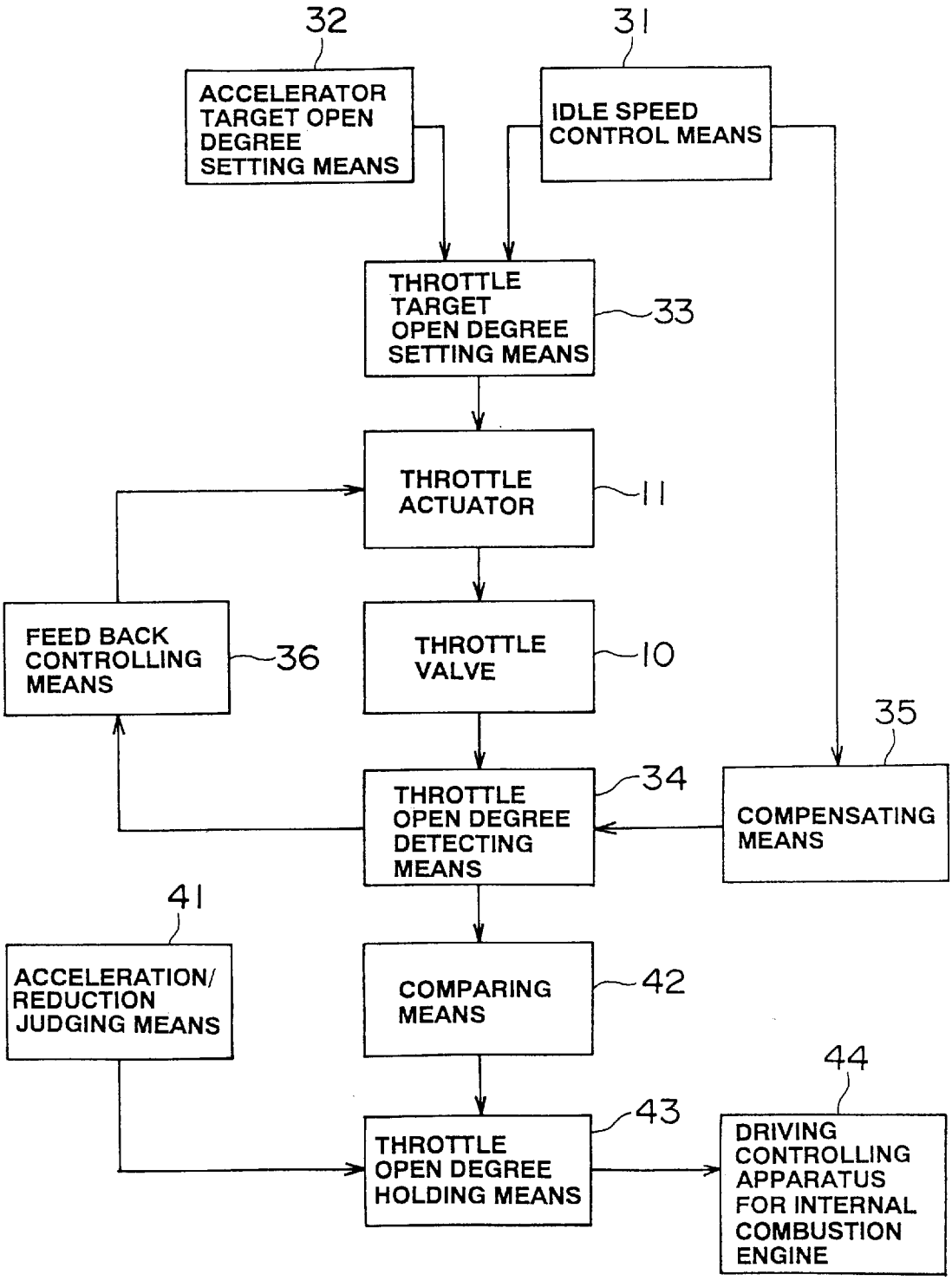
FIG. 8 is a functional block diagram showing an embodiment 2 according to the present invention.

Herein, a program executed in the CPU, as shown in FIG. 8, is different from the embodiment 1 by realizing function realizing means in the following points.

That is, in addition to (1) the idle speed control means 31, (2) the accelerator target open degree setting means 32, (3) the throttle target open degree setting means 33, (4) the throttle open degree detecting means 34, (5) the compensating means 35, and (6) the feed back means 36 as in the embodiment 1, the following means are provided in Embodiment 2.

(7) acceleration/reduction judging means 41 judging whether a vehicle is under the acceleration state or the reduction state;

Whether the vehicle is under the acceleration or not can be detected by the well-known techniques such as a speed sensor or a gravity sensor, but it is also possible to detect differences between the present throttle open degree detected and the throttle target open degree.

In other words, an acceleration judging value (ΔTA: changes per hour for throttle open degree) is obtained in the following expression (3). When this acceleration judging value is positive, it is judged under the reduction state and when this value is negative, it is judged under the acceleration state.

$$\text{Acceleration/reduction judging value } (\Delta TA) = \text{throttle open degree } (TA1) - \text{throttle target open degree} = \{\text{throttle sensor A/D value } (TAAD) - \text{throttle fully closed learning value } (GTA)\} - \text{throttle target open degree} \quad (3)$$

(8) comparing means 42 comparing the throttle open degree after compensation by the compensating means 35 with the throttle open degree after compensation which was measured previously;

In the throttle open degree detecting means 34 periodically (herein at every 8 ms.) calculates a throttle open degree (TA2) according to the expression (2), which is held in the RAM 24. The value of the throttle open degree (TA2) is stored, first as a temporary file, in a variable tTA. At every periodical measurement, the content of tTA is then stored in a variable TA8 which means the previously measured value, and is renewed.

The comparing means compares the throttle open degree TA8 of the previous measurement obtained by the expression (2) with the throttle open degree tTA measured at this time and the comparative result is transferred to the throttle open degree holding means 43.

(9) throttle open degree holding means 43 holding the previous throttle open degree as originally required throttle open degree when the acceleration/reduction judging means judged as under acceleration and the comparing means decided that the present throttle open degree is smaller than the previous throttle open degree, in addition to when the acceleration/reduction judging means judged under reduction and the comparing means decided that the present throttle open degree is larger than the previous throttle open degree;

The throttle open degree holding means 34 maintains the originally required throttle open degree by receiving the judging result of the acceleration/reduction judging means 41 and the comparative result of the comparing means 42 and by satisfying the conditional expressions (4)–(7).

First, acceleration/reduction judging value $$(\Delta TA) < -EDLTAT \quad (4)$$

and $$tTA < TA8 \quad (5)$$

Here, the EDLTAT shows the dead zone of throttle valve where the throttle valve does not respond between −EDLTAT~+EDLTAT. According to the present invention, the range is −0.122 deg~0.122 deg.

When satisfying both the expressions, that is, the acceleration/reduction judging value (ΔTA) is lower than −EDLTAT (means it is under acceleration) and when the present throttle open degree tTA is smaller than the previous throttle open degree TA8, tTA=TA8, the previous throttle open degree is considered as the throttle open degree at this time and this value tTA is maintained as originally required throttle open degree TA.

Next, acceleration/reduction judging value $$(\Delta TA) > EDLTAT \quad (6)$$

and $$tTA > TA8 \quad (7)$$

When satisfying the both as mentioned, that is, the acceleration/reduction judging value (ΔTA) is more than the EDLTAT (means it is under reduction) and when the present throttle open degree tTA is larger than the previous throttle open degree TA8, tTA=TA8, the previous throttle open degree is considered as the throttle open degree at this time and this value tTA is maintained as the originally required throttle open degree TA.

When the TA2 is negative, tTA≧0.0 (deg) Finally, either the acceleration or reduction, the throttle open degree held in a memory as the variable tTA in the temporary file is transferred to the variable TA for controlling data (TA←tTA).

(Operation and effect of the embodiment 2)

The operational example of the embodiment 2 will be explained with reference to a flowchart of FIG. 9 and a timing chart of FIG. 10.

Figure 9:
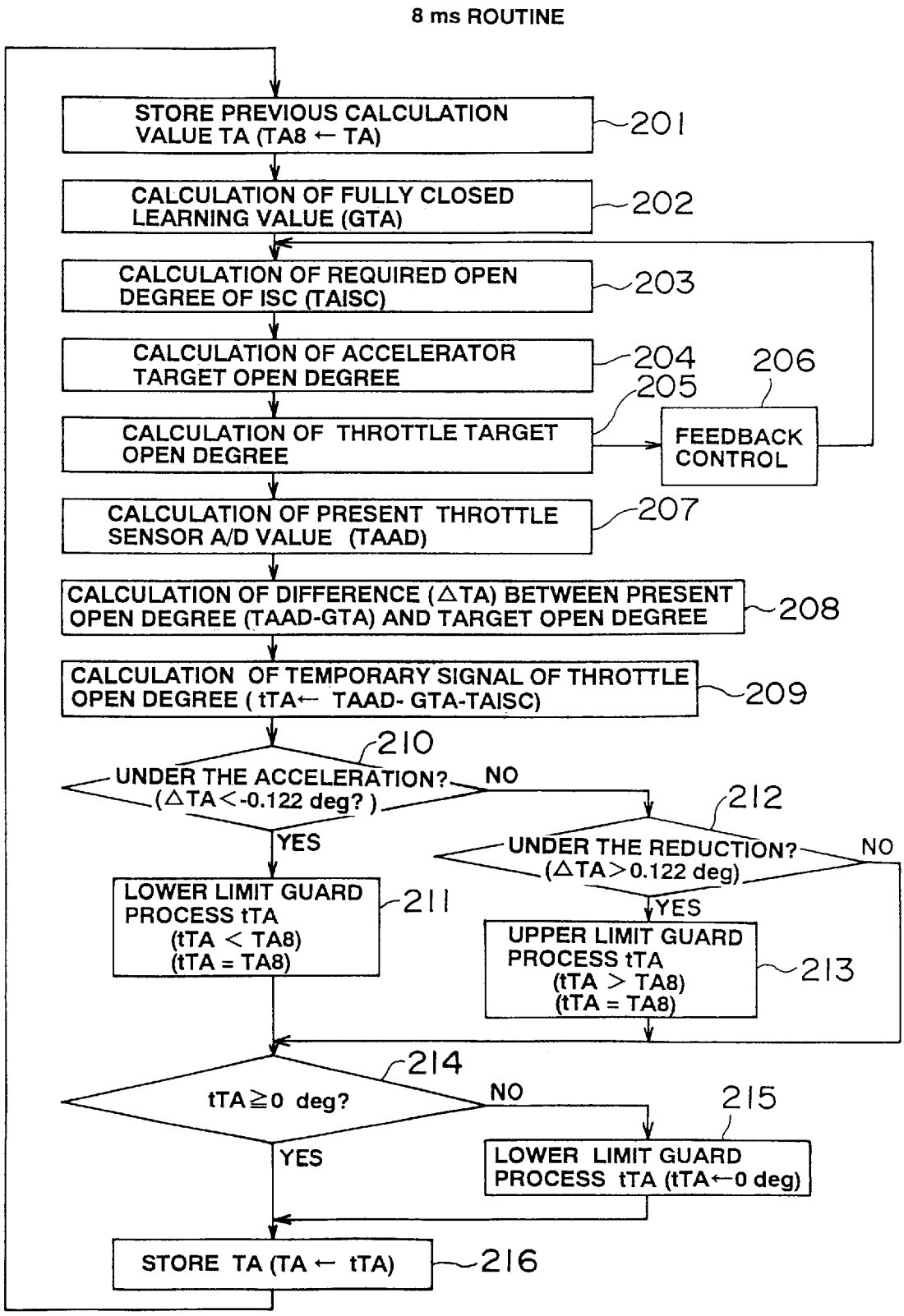
FIG. 9 is a flowchart showing actions of the embodiment 2.

First, the calculation of the throttle open degree for various controls is executed according to the flowchart of FIG. 9 as a routine program at every 8 ms. The throttle open degree calculated at the time of the previous execution by the expression (2) is stored in the RAM as the previous calculation value TA8 (step 201). When this step is when the engine is started, the initial value becomes null since the previous open degree was not detected.

Next, when the engine is started, the throttle valve is fully closed. The fully closed position is stored as the throttle fully closed learning value (GTA) (step 202).

The idle target open degree is calculated by the ISC means 31 in accordance with the engine coolant temperature, etc. shown in the maps of FIGS. 3–5 (step 203).

Further, the accelerator operation amount is calculated by signals from the accelerator position sensor 17 in response to the pressing amount of the accelerator pedal by the driver. The accelerator target open degree is led from the map in accordance with the accelerator target open degree setting means 32 (step 204).

The obtained idle target open degree and the accelerator target open degree are added so as to obtain the throttle target open degree for the target controls (step 205).

Usually, the throttle valve is controlled by the feed back control means 36 so as to be consistent with the throttle target open degree (step 206).

In the embodiment 1, here, according to the expression (2), the expression (1) is compensated by the compensating means 35 and influences by the ISC means 31 are canceled. However, even when the amount of ISC was canceled, mechanical delays occur in the actually measured throttle sensor A/D value (TAAD) due to delay of mechanical actions/motor actions of the throttle valve. As a result, the idle target open degree becomes small by turning off the air conditioner, etc., even when the idle target open degree is canceled by the compensating means in calculating the throttle open degree, the delay portion is shown in a mountain (M) due to delay, as in the timing chart of FIG. 10 (10-3).

Originally, in spite of that the throttle target open degree is 0 (point P), the calculated throttle open degree does not yet become 0 (point Q) because of the existence of the mountain (M). This is used for the fuel injection controls as controlling data and may cause an inappropriate control.

Therefore, the following processes are conducted in order to cancel the mountain portion by the delay.

In other words, the throttle sensor A/D value at the present time is calculated in step 207. Next, the acceleration/reduction judging value is obtained in the expression (3) by the acceleration/reduction judging means 41 in step 208.

Further, a temporary signal of throttle open degree (tTA) is calculated (step 209). Here, according to the expression (2) by the throttle open degree detecting means 34, the throttle open degree (TA2) including the compensation by the compensating means 35 is calculated and is stored as a variable tTA in the RAM 24.

Next, whether or not the acceleration/reduction judging means 41 is under the acceleration (acceleration/reduction judging value (ΔTA)<−EDLTAT (−0.122 deg)) is judged (step 210). When it is judged under the acceleration, it was decided that it is the condition that the present throttle open degree is smaller than the previous throttle open degree (tTA<TA8) by the comparing means 42, the previous throttle open degree is maintained as the originally required throttle open degree (tTA=TA8) (step 211). This is called a lower limit guard process tTA.

Next, when it was judged not under the acceleration in step 210, the acceleration/reduction judging means 41 further judges whether it is under reduction (acceleration/reduction judging value (ATA)>EDLTAT (0.122 deg)) is judged (step 211). When it is judged under the reduction, it was decided that it is the condition that the present throttle open degree is larger than the previous throttle open degree by the comparing means 42 (tTA>TA8), the previous throttle open degree is held as the originally required throttle open degree (tTA=TA8) (step 213). This is called an upper limit guard process tTA.

After processing steps 211, 212 and 213, either proceeds to step 214 and it is judged that the condition is tTA>=0.0 (deg). When this condition is not satisfied, it is tTA←0 (deg) (step 215). That is, the lower limit of tTA is set 0.

When the conditional judgement of tTA>=0.0 (deg) is satisfied in step 214, a temporary throttle open degree tTA is held as the originally required TA(t) (step 216).

Figure 10:
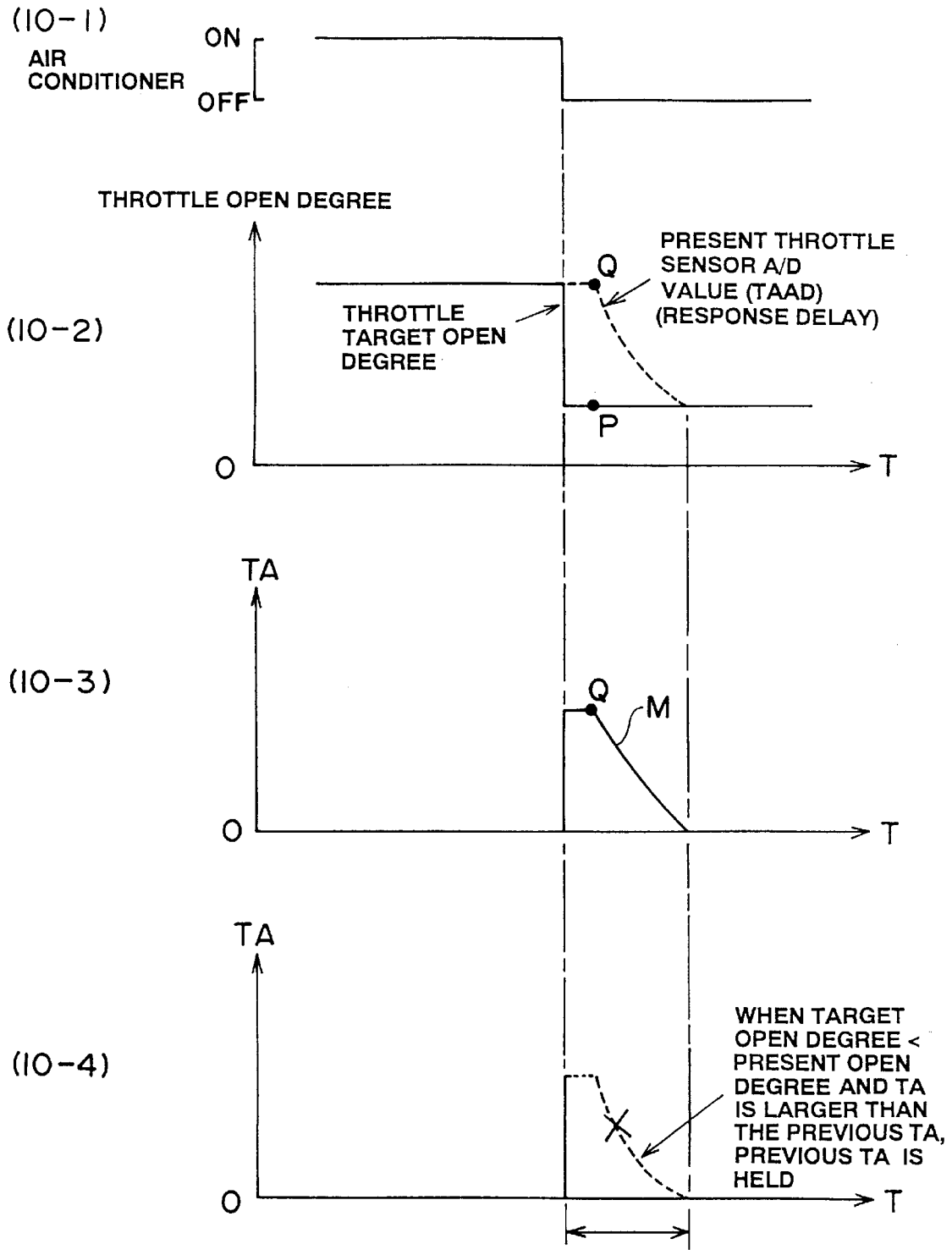
FIG. 10 is a timing chart showing actions of the embodiment 2 according to the present invention.

Referring to the timing chart of FIG. 10 for the above processes, the throttle sensor A/D value remains bigger than the target open degree due to the mechanical delay of the throttle valve when the idle open degree becomes 0 by turning the air conditioner OFF. However, when the upper guard process tTa is conducted, the throttle open degree due to the response delay is ignored as in (10-4) and the influences due to the response delay can be canceled since the previous detected throttle open degree is given a priority.

<Applicability of the present invention>

The throttle open degree obtained as mentioned above, that is, the values of the throttle open degree (TA2) in the embodiment 1 or the throttle open degree TA(t) in the embodiment 2 can be used as data for the driving controlling apparatus for the internal combustion engine 44 such as the fuel injection control, or the fuel ignition control. By applying various controlling apparatuses and methods described in the following publications to the original throttle open degree TA2, TA(t) obtained by the present invention, the detection of acceleration/reduction in response to the driver's intention or the prediction of air intake amount are possible. Thus, more preferable controls are possible.

A controlling technique of air/fuel ratio in an electronically control engine is disclosed in Japanese Patent Laid-Open No. 60-50241, in which the acceleration/reduction is detected by changes of the throttle open degree per hour unit (ΔTA), and the fuel injection is increased or decreased in accordance with the detected result. That is, the publication disclosed a controlling method that a fuel injection amount is determined in response to the engine driving condition such as the engine load or the engine revolution speed and a process of the fuel injection is conducted so as to ease the acceleration/reduction shock when the acceleration or reduction state. This method is that a target value of the fuel injection is obtained in response to the driving condition, a degree of the acceleration/reduction is detected from the changes of the throttle open degree per hour unit. A permissible change amount of the fuel infection within a range that does not cause the acceleration/reduction shock in response to the detected acceleration/reduction degree is obtained so that the fuel injection amount is approached to the target value. When this method is combined with the present invention, the control corresponding to more accurate throttle open degree can be conducted.

An electric-type fuel injection controlling apparatus for an internal combustion engine is disclosed in Japanese Patent Publication No. 47-41288 in which the fuel injection amount is increased by the changing speed of the previous ΔTA.

The apparatus consists of means for generating output signals in response to the open degree speed of the throttle valve and means for opening wide the fuel injection valve so as to inject more fuel than the fuel injection amount in response to the usual driving condition when the value of output signal generated is more than the predetermined value. When the present invention is applied to the apparatus, it is possible to obtain an increase of accurate fuel injection amount by the speed of the accurate open degree of throttle valve.

Japanese Patent Publication No. 2-56493 disclosed a fuel injection controlling method for increasing a fuel injection by judging an acceleration by ΔTA.

That is, this is a method that a changing amount of the open degree of the throttle valve is detected and a first compensating value in excess of the fuel injection is obtained based on the detected value. The fuel injection amount is compensated and injected based on the first compensating value in excess and a pressure changing amount of intake pipes are detected. A second compensating value in excess is obtained from the pressure changing amount of intake pipes. When the second compensating value becomes larger than the first compensating value, the compensation of fuel injection amount is switched to the second compensating value from the first compensating value.

Again in this case by applying the present invention, it is possible to obtain more accurate changes of the open degree of the throttle valve and is possible to compensate the accurate fuel injection amount.

In Japanese Patent Laid Open No. 2-42160 disclosed an apparatus for predicting an air intake amount from ΔTA. The apparatus consists of throttle open degree detecting means for detecting a throttle open degree, engine speed detecting means, measuring means for measuring an air intake amount or a physical amount in response to the air intake amount intaken to the engine combustion chamber, first calculating means for calculating a present value of an air intake amount or a physical amount in response to the air intake amount intaken to the engine combustion chamber based on the throttle open degree and the engine speed, predicting means predicting a value at a predicting point of the prescribed time beforehand rather than the present value at the present point and second calculating means calculating the intake air amount at the predicting point or the physical amount in response to the intake air amount, based on a difference between the present value or the predicting value and the measured value by the measuring means, or, a difference between the present value of the intake air amount or the physical value in response to the intake air amount and the measured value by the measuring means and the predicting value by the predicting means.

By applying this apparatus to the present invention, the detected value by the throttle open degree detecting means becomes more accurate. A prediction of the air intake amount in the apparatus can be conducted more accurately.

Further, Japanese Patent Laid Open No. 60-159372 disclosed an ignition timing controlling method in an internal combustion engine that controls the fuel ignition timing by changing the throttle open degree when idling.

In other words, the ignition timing controlling method for internal combustion engine is disclosed in that when the throttle valve is open, the ignition timing is controlled based on the ignition advancing of a basic ignition advancing which is set by an engine load and an engine speed, and when the throttle valve is the idling position, the ignition timing is controlled by the idling ignition advancing. When the throttle valve is open wider than the idling position, the ignition timing is controlled by delaying either the ignition advancing of the delaying side among the ignition advancing based on the basic ignition advancing or the idling ignition advancing to the amount in response to the size of the acceleration of engine.

By applying to the present invention, an accurate ignition timing is controlled in accordance with the changes of the throttle open degree when idling.

Japanese Patent Laid Open No. 59-145364 disclosed an ignition timing controlling method in an internal combustion engine by judging an acceleration by ΔTA and advancing the fuel ignition liming.

The method includes a process for obtaining the ignition timing from the intake air amount and the engine speed, a process for detecting a sudden acceleration by changes of the throttle open degree, and a process for advancing the ignition timing after detecting the sudden acceleration. By applying this method to the present invention, it is possible to detect the sudden acceleration accurately.

According to the present invention, it is possible to detect a throttle open degree which is not influenced to the throttle open degree control for idling and enable to control responsive to a driver's intention.

Further, influences of the change of the detected value of the throttle open degree due to operational delays of the throttle valve can be avoided.

Therefore, the controls to the internal combustion engine using the throttle open degree obtained by the present invention are optimized.

What is claimed is:

1. A driving controlling apparatus for an internal combustion engine having a throttle valve in which a throttle open degree is controlled to become a throttle target open degree, where driving controls to the internal combustion engine are conducted based on the throttle open degree, the throttle open degree required when idling is set as an idle target open degree, an accelerator target open degree in response to the accelerator operation is set, a throttle target open degree is set including both the idle target open degree and the accelerator target open degree, comprising:

throttle open degree detecting means for detecting a throttle open degree; and compensating means for compensating the throttle open degree detected by the throttle open degree detecting means in view of the idle target open degree;

wherein the driving of the internal combustion engine is controlled based on the throttle open degree compensated by the compensating means.

2. The driving controlling apparatus for throttle valve in the internal combustion engine according to claim 1, wherein the compensating means compensate the throttle open degree by subtracting the idle target open degree from the throttle open degree detected by the throttle open degree detecting means.

3. The driving controlling apparatus according to claim 1, further comprising:

acceleration/reduction judging means for judging whether the vehicle is under the acceleration condition or the reduction condition;

comparing means for comparing the throttle open degree after compensated by the compensating means with the previously measured throttle open degree after compensated; and throttle open degree holding means for holding a previous throttle open degree as originally required throttle open degree when the acceleration/reduction means judged as the acceleration state and the comparing means judged that the present throttle valve open degree is smaller than the previous throttle open degree, the previous throttle open degree is hold as the originally required throttle open degree, and when the acceleration/reduction judging means judged as the reduction state and the comparing means judged that the present throttle open degree is larger than the previous throttle open degree.

4. A driving controlling apparatus for an internal combustion engine where driving controls to the internal combustion engine are conducted based on changes of a throttle open degree, the throttle open degree required when idling is set as an idle target open degree, an accelerator target open degree in response to the accelerator operation is set, a throttle target open degree is set including both the idle target open degree and the accelerator target open degree and a throttle valve is feed-back controlled for the throttle target open degree, comprising:

throttle open degree detecting means for detecting a throttle open degree; and compensating means for compensating the throttle open degree detected by the throttle open degree detecting means in view of the idle target open degree;

wherein the driving of the internal combustion engine is controlled based on the throttle open degree compensated by the compensating means.

* * * * *